US005080731A

United States Patent [19]

Tabaru et al.

[11] Patent Number: 5,080,731

[45] Date of Patent: Jan. 14, 1992

[54] HIGHLY ORIENTED PERMANENT MAGNET AND PROCESS FOR PRODUCING THE SAME

[75] Inventors: Kazunori Tabaru; Motoharu Shimizu, both of Saitama, Japan

[73] Assignee: Hitachi Metals, Ltd., Tokyo, Japan

[21] Appl. No.: 393,736

[22] Filed: Aug. 15, 1989

[30] Foreign Application Priority Data

Aug. 19, 1988 [JP] Japan ..... 63-205849

[51] Int. Cl.[5] ..... H01F 1/04

[52] U.S. Cl. ..... 148/103; 148/104; 419/39; 419/42

[58] Field of Search ..... 148/104, 103; 419/39, 419/42

[56] References Cited

FOREIGN PATENT DOCUMENTS 58-153306 9/1983 Japan ..... 148/104

*Primary Examiner*—John P. Sheehan

*Attorney, Agent, or Firm*—Sughrue, Mion, Zinn, Macpeak & Seas

[57] ABSTRACT

A highly oriented rare earth based permanent magnet satisfies the relationship $a \geqq b > c$ where a is the longer side or major axis of the magnet, b is the shorter or minor axis of the magnet, and c is the thickness of the magnet, and that has a flat shape which is magnetized in the direction of thickness c, with the direction of magnetization being inclined at an angle of no more than 3 degrees with respect to the line normal to the plane defined by a and b. The magnet is produced by loading an alloy powder as the starting material into a mold having a cavity that satisfies the relationship $A \geqq B > C$ where A is the longer side or major axis of the cavity, B is the shorter side or minor axis of the cavity, and C is the depth of the cavity; exerting a compressive force of at least 0.4 tons/cm$^2$ in a direction substantially perpendicular to the plane defined by A and C while applying a magnetic field in a direction substantially perpendicular to the plane defined by A and B, thereby effecting in-field molding so as to obtain a preform; and performing cold isostatic pressing at a pressure higher than that employed in the preforming step.

2 Claims, 3 Drawing Sheets

HIGHLY ORIENTED PERMANENT MAGNET AND PROCESS FOR PRODUCING THE SAME

BACKGROUND OF THE INVENTION

The present invention relates to a highly oriented permanent magnet such as a "wiggling" magnet used to pick up radiation from particle accelerators or one which is employed in an MRI (nuclear magnetic tomographic resonance imaging) device. More particularly, the present invention relates to a permanent magnet having the direction of magnetization inclined at a very small angle with respect to the line normal to a reference plane, as well as a process for producing such a permanent magnet.

Free electron lasers and particle accelerators such as synchrotrons have output radiation picked up by means of a plurality of permanent magnets disposed in an array. In those apparatus, a continuous array of permanent magnets called "wigglers" or "undulators" is disposed on either side of the channel of electron beams, with adjacent permanent magnets and those opposed to each other being arranged to have opposite polarity so that an alternating magnetic field is applied perpendicularly to the direction in which the electron beams travel. Some apparatus employ a "hybrid" system in which an array of permanent magnets are combined with yokes made of such as alloys as Permendur and Permalloy.

An example of "wiggler" array is shown in FIG. 5. Several tens of magnet pairs which are magnetized in such a way that fluxes come into and go out of the magnets perpendicularly to the planes ab which are defined by the longer side a and the shorter side b of the magnets which are arranged to present alternating N and S poles. Electron beams passing between two "wiggler" arrays are bent as they travel through the alternating magnetic field, with subsequent emission of radiation having a specified wavelength.

The permanent magnets used in the applications described above are required to have high magnetic characteristics and those which are made of anisotropic rare earth elements such as Sm-Co and Nd-Fe B systems are commonly employed to satisfy this requirement. Permanent magnets to be used as "wigglers" are generally designed to satisfy the relationship $a \geqq b > c$ where a is the longer side or major axis of an individual magnet, b is the shorter side or minor axis of the magnet, and c is the thickness of the magnet. The requirement for permanent magnets that are to be used as "wigglers" in particle accelerators is particularly stringent in that the direction of magnetization should not be inclined with respect to the line normal to an installation reference plane at an angle exceeding 3 degrees, preferably not exceeding 2 degrees. If the angle of inclination exceeds 3 degrees, a component of magnetic field that is not perpendicular to the direction in which electron beams travel will develop and the resulting decrease in the effective component will cause problems such as variations in the bending of electron beams and hence the wavelength of output radiation. It is therefore required that the angle at which the direction of magnetization is inclined should be uniformly distributed in the plane ab of a permanent magnet and should not exceed 3 degrees, preferably 2 degrees.

The demand for constructing particle accelerators of a larger capacity is increasing today. To meet this need, large permanent magnets are fabricated by assembling a plurality of magnet blocks with an adhesive. However, the attempt to bond a plurality of magnet blocks with an adhesive to make a larger anisotropic permanent magnet involves the following problems. First, the adhesive layer between adjacent magnet blocks forms a magnetic gap and the resulting decrease in magnetic flux in that area causes unevenness in the overall magnetic characteristics, with subsequent deterioration in the performance of an apparatus that employs the magnet assembly. Second, when a large anisotropic permanent magnet is incorporated into a free electron laser or a particle accelerator, it is placed under high vacuum in an environment containing ultraviolet radiation, so there is high likelihood that the adhesive used to bond magnet blocks deteriorates as a result of destruction of the polymeric structure of the resin on account of an uv initiated photochemical reaction. Further, the procedure of assembling a plurality of magnet blocks by bonding them together with an adhesive is not only complicated but also time- o consuming and it has been difficult to supply products of consistent and uniform quality.

The process of fabricating permanent magnets consists of molding a magnet material and sintering the molding. A problem with this process, if it is employed to make a large anisotropic permanent magnet, is that the molded magnet material often warps due to shrinkage that occurs during sintering. Compared to small ones, large magnets tend to develop large cracks or extensive warps. This is due to the following two problems which are encountered in the method of achieving orientation in a magnetic field in the conventional mold. First, unevenness in the distribution of pressure in the molding will introduce unevenness in its density. Second, unevenness in the magnetic field for orientation in the mold will introduce unevenness in the degree of orientation achieved. It is worthwhile to consider the second problem in somewhat greater detail. To satisfy the requirements for strength and rigidity, the conventional mold often has a monolithic structure of ferromagnetic materials such as tool steels and at the edges of the molding cavity, magnetic fluxes tend to pass through the mold more easily than the molding which has a lower permeability than the mold. For the reasons described above, the conventional mold has not been suitable for use in making wiggling magnets by shaping in a magnetic field.

With a view to overcoming this bottleneck, a cold isostatic pressing method (abbreviated as CIP) has been proposed in JP-A-62-64498 (the term "JP-A" as used herein means an "unexamined published Japanese patent application"). This method employs an in-field wet rubber press comprising a nonmagnetic container, an upper and a lower punch that are made of a magnetic material and that are adapted to penetrate through said container for pressurizing in said container a powder provided as a molding material, two coils wound around the two punches to produce a magnetic field acting upon the powder charged between said two punches, and an orifice bored through the side wall of said container and through which water is supplied to exert hydrostatic pressure on the powder to be pressurized in said magnetic field. The drawing of JP-A-62-64498 illustrates the relationship between the intensity of X-ray diffraction at a (002) surface and the angle of inclination with respect to the direction in which the magnetic field is applied, and shows that comparatively improved orientation can be achieved by CIP.

The above-described method of using an in-field wet rubber press, however, has its own problems. First, it is essential for this method to use an upper and a lower punch made of a magnetic material but then, the pressurizing force exerted by the rubber press is not isostatic but lateral pressure will be added. Not only does this uneven application of pressures cause deformation of the molding at its edges but also the angle at which the direction of magnetization is inclined will be affected. Second, the mold is required to have sufficient strength to withstand the pressure exerted by CIP. Third, sufficient electrical insulation must be provided to permit coils to be installed within the CIP apparatus. All of these factors present considerable difficulty from both technical and safety viewpoints.

Further, none of the permanent magnets fabricated by this method have yet satisfied the already-described requirements for "wigglers" in particle accelerators. This is because the application of the invention described in JP-A-62-64498 is limited in practice to a method commonly referred to as "longitudinal magnetic field pressing" in which the pressing direction is parallel to the direction in which a magnetic field is applied and there is a certain limit on the improvement that can be achieved in the degree of orientation.

The magnetic particles of which rare earth based permanent magnets are made are generally flat and their longitudinal direction substantially coincides with the easy axis of magnetization, and when the magnetic particles loaded into the mold are pressurized, they tend to orient in such a way that their longitudinal direction is perpendicular to the direction in which they are compressed. Therefore, if one wants to fabricate a permanent magnet of high performance, it is preferred to employ a method called "lateral magnetic field pressing" in which molding is effected in a magnetic field that is applied in a direction perpendicular to the pressing direction because this contributes to an improvement in the degree of orientation.

Under the circumstances described above, it has been strongly desired to develop a permanent magnet in which the angle of inclination of magnetizing direction is very small and uniformly distributed and which has previously been considered difficult to fabricate by shaping in a magnetic field in the prior art mold. A need has also been recognized for producing such a permanent magnet by a method that utilizes the advantages of both the lateral magnetic field pressing and CIP processes.

SUMMARY OF THE INVENTION

An object, therefore, of the present invention is to provide a large rare earth based permanent magnet that is suitable for use as a "wiggler" in a particle accelerator and that has the direction of magnetization inclined at a very small angle.

This object of the present invention can be attained by a highly oriented rare earth based permanent magnet that satisfies the relationship $a \geqq b > c$ where a is the longer side or major axis of the magnet, b is the shorter or minor axis of the magnet, and c is the thickness of the magnet, and that has a flat shape which is magnetized in the direction of thickness c, with the direction of magnetization being inclined at an angle of no more than 3 degrees with respect to the line normal to the plane defined by a and b.

DETAILED DESCRIPTION OF THE INVENTION

The rare earth based permanent magnet of the present invention may be comprised of a rare earth-cobalt system or a rare earth—transition metal—boron system. Needless to say, a magnet of a rare earth transition metal—boron system which is partly replaced by no more than 13 wt% of elements selected from among Ga, Si and Al, is included within the scope of the present invention. Rare earth based systems are selectively used because they enable the production of flat and strong magnets from the viewpoint of permeance coefficient.

The permanent magnet of the present invention which satisfies the already-described stringent requirements for use as "wigglers" in particle accelerators can be produced by a two-stage molding process in which a preform of a given shape is first prepared by shaping in a magnetic field in a mold that is adapted to create a uniform parallel magnetic field and then the preform is subjected to final shaping by CIP.

Figure 2:
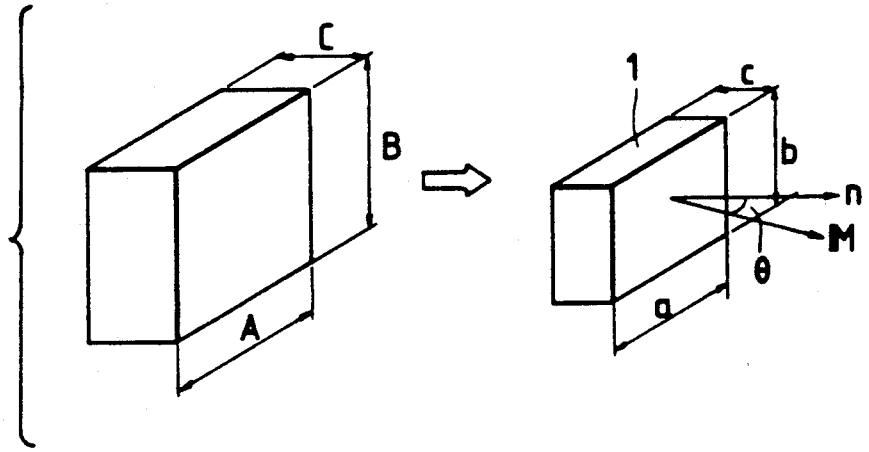
FIG. 2 is a diagram showing a permanent magnet according to an embodiment of the present invention.

As shown in FIG. 2, the rare earth based magnet 1 of the present invention satisfies the dimensional relationship $a \geqq b > c$ where a is the longer side or major axis of the magnet, b is the shorter side or minor axis of the magnet, and c is the thickness of the magnet, and it also has the direction of magnetization M inclined at an angle of $\theta$ not exceeding 3 degrees with respect to the line n normal to the plane defined by a and b.

Figure 1:
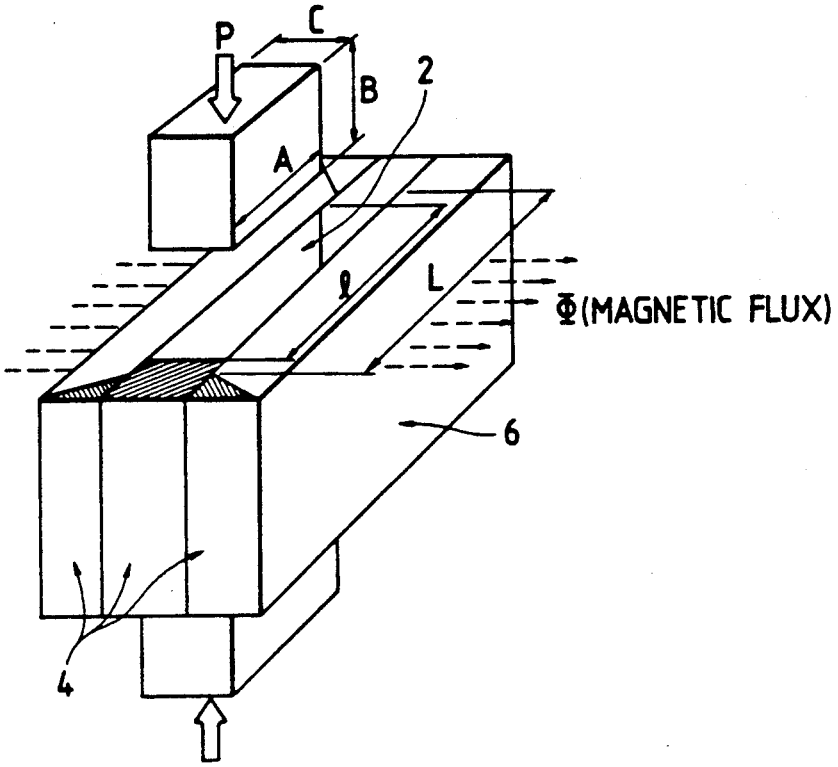
FIG. 1 is a diagram showing the process for making the magnet of the present invention.

This rare earth based magnet can be produced by a process which comprises the following steps: loading an alloy powder as the starting material into a mold which is composed of ferromagnetic material members 6 and nonmagnetic material members 4 and has a cavity 2 that satisfies the relationship $A \geqq B > C$ where A is the longer side or major axis of the cavity, B is the shorter side or minor axis of the cavity, and C is the width of the cavity (see FIG. 1), and that is formed in a substantially uniform parallel magnetic field; exerting a compressive force of at least 0.4 tons/cm$^2$ in a direction substantially perpendicular to the plane defined by A and C while applying a magnetic field in a direction substantially perpendicular to the plane defined by A and B, thereby effecting in-field molding so as to obtain a preform having the direction of magnetization inclined at an angle of no more than 2 degrees with respect to the line normal to the plane defined by A and B; and increasing the density of said preform by performing cold isostatic pressing at a pressure higher than that employed in the preforming step.

The accomplishment of the present invention is based on the finding by the present inventors of the fact that desirable results can be attained by performing preliminary shaping of the starting powder in a magnetic field at comparatively low pressure before it is subjected to cold isostatic pressing (CIP). If the starting material solidifies upon preliminary shaping, the particles are oriented and are no longer capable of moving around. If the molded preform is put into a liquid-impermeable rubber or synthetic resin bag, the magnetic orientation of the preform is retained even if it is subjected to subsequent CIP. According to the present invention, a preform of uniform high density is obtained and a magnet with adequately good magnetic characteristics can be produced even if low sintering temperatures are employed. The preformed block does not yet possess sufficient density and strength so that it might collapse when it receives the weight of the upper punch in the molding step. Thus, it is recommended that a hydraulic press having a lifting capability be used to ensure that springback will prevent the occurrence of cracking and other defects in the block.

In the preforming step, a magnetic field may be applied in a direction parallel to the pressing direction, but in order to produce a large magnet having good magnetic characteristics, the lateral magnetic field pressing method in which a magnetic field is applied in a direction perpendicular to the pressing direction is preferred. Therefore, the present inventors conducted intensive studies to make a desired magnet by the lateral magnetic field pressing method without suffering from the problem of unevenness in magnetic field at the edges of the mold cavity which had been encountered in pressing with the conventional mold. As a result, it was found that a uniform magnetic field could be created in the cavity 2 of the mold shown in FIG. 1 when a part of the nonmagnetic material mold members 4 was designed to project inward so as to satisfy the dimensional relationship $L>l$.

Another requirement for the permanent magnet of the present invention is that the direction of magnetization be inclined at an angle not exceeding 3 degrees, preferably no more than 2 degrees, with respect to the line normal to the plane defined by a and b, for example, the reference plane for the installation of "wiggler" magnets in a particle accelerator. In order to make direct checking as to whether this strict requirement is met, the present inventors devised a measuring instrument using a Helmholtz coil. Other applicable methods, not necessarily reliable though, include: determining the angle of inclination with respect to the direction in which a magnetic field is applied by measuring the intensity of X-ray diffraction from a (002) surface as described in JP-A-62-64498; X-ray diffractiometry; and measuring the uniformity of surface magnetic flux distribution in the product as an alternative characteristic to the angle at which the direction of magnetization is inclined with respect to the line normal to the reference plane. If desired, the magnetic fluxes detected with an integrating fluxmeter using three search coils, x, y and z, may be subjected to information processing with a computer by making use of the operating principles of a vibrating-sample magnetometer (VSM) and this method also insures high-precision measurement.

The following examples are provided for the purpose of further illustrating the present invention but are in no way to be taken as limiting.

EXAMPLE 1

A $SmCo_5$ alloy for a permanent magnet consisting of 38 wt% Sm and the balance Co was arc melted and cast into an ingot. The ingot was crushed coarsely with a stamp mill to obtain particles that passed through a 35-mesh screen. Those particles were comminuted with a ball mill for 3 hours. The resulting magnetic particles were loaded into a die having cross-sectional dimensions of a =69 mm and b=45 mm, and subjected to preliminary shaping with a uniaxial press having a lifting capability at a pressure of 0.7 tons/cm$^2$, with a magnetic field of 13 koe being applied in a direction parallel to the pressing direction, until a preform with a height of 16 cm was obtained.

The preform was then transferred into a latex rubber mold having cross-sectional dimensions of a =69 mm and b=45 mm. Since the preform was strong enough to withstand a drop test without breaking, there was no need to exercise special care in handling it.

The preform in the rubber bag was subjected to CIP at a pressure of 4 tons/cm$^2$ to attain a height (c) of 14 cm. The molding was sintered at 1140° C. for 1 hour in argon gas and subsequently heated at 1000° C. for 1 hour in argon gas. The CIP shaped test piece was found to have satisfactory density and the shrinkage that developed as a result of sintering was negligibly small. Thus, the only post-treatment that had to be performed on the molding was to remove the surface oxide film.

As a comparison, the same starting powder was loaded into a rubber latex bag having cross-sectional dimensions of a =70 mm and b=46 mm and was immediately subjected to CIP without performing preliminary shaping. CIP was effected at a pressure of 4 tons/cm$^2$ until the height (c) of the molding was 16 mm. The CIP shaped part was demolded and subjected to sintering and heat treatment under the same conditions as described above. The test piece was deformed at the edges and had to be ground and polished to the final size of a =69 mm, b=45 mm and c=14 mm.

Figure 3:
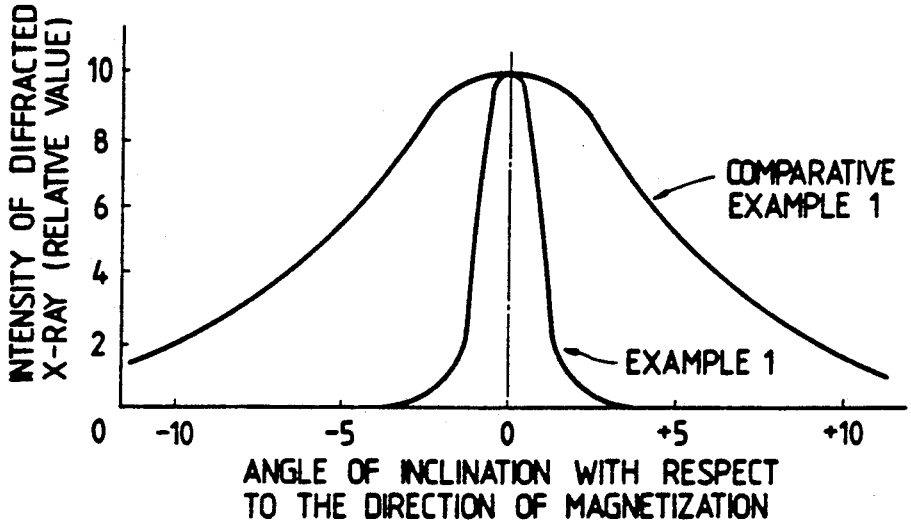
FIG. 3 is a graph showing the results of measuring the orientation of the permanent magnet according to an embodiment of the present invention by X-ray diffractiometry.

The intensity distribution of diffraction from a (002) surface with respect to the direction of magnetization in which a magnetic field was applied to the test pieces is depicted in FIG. 3. The vertical axis of the graph plots relative intensities to the maximum diffraction intensity. As one can see from FIG. 3, the orientation of the comparative sample was not uniform and produced a broad intensity distribution whereas the sample of the present invention had a high degree of orientation with a sharp peak in intensity distribution.

The magnetic characteristics of the two samples are shown in Table 1. The values for each sample are indicated in three rows; the values in the top row refer to the magnetic characteristics of a portion of the specimen facing the upper punch, the values in the middle row refer to the magnetic characteristics of the central portion, and the values in the bottom row refer to the magnetic characteristics of a portion of the specimen facing the lower punch. As one can see from Table 1, the magnetic characteristics of the comparative sample were highly variable and had low absolute values, whereas the sample of the present invention provided a magnet that had uniform magnetic characteristics with high absolute values.

TABLE 1

| | Br (KG) | iHc (kOe) | $(BH)_{max}$ (MGOe) |
|---|---|---|---|
| sample of | 9.8 | 17.5 | 20.7 |

TABLE 1-continued

| | Br (KG) | iHc (kOe) | $(BH)_{max}$ (MGOe) |
|---|---|---|---|
| the invention | 9.6 | 17.4 | 20.6 |
| | 9.9 | 17.5 | 20.8 |
| comparative sample | 7.9 | 16.4 | 16.7 |
| | 7.6 | 16.7 | 16.2 |
| | 7.9 | 16.6 | 15.9 |

Measurements were also conducted for the angle at which the direction of magnetization was inclined with respect to the line normal to the reference plane; the angle was 0.7 degrees in the sample of the present invention whereas it was as large as 5.4 degrees in the comparative sample.

EXAMPLE 2

Figure 4:
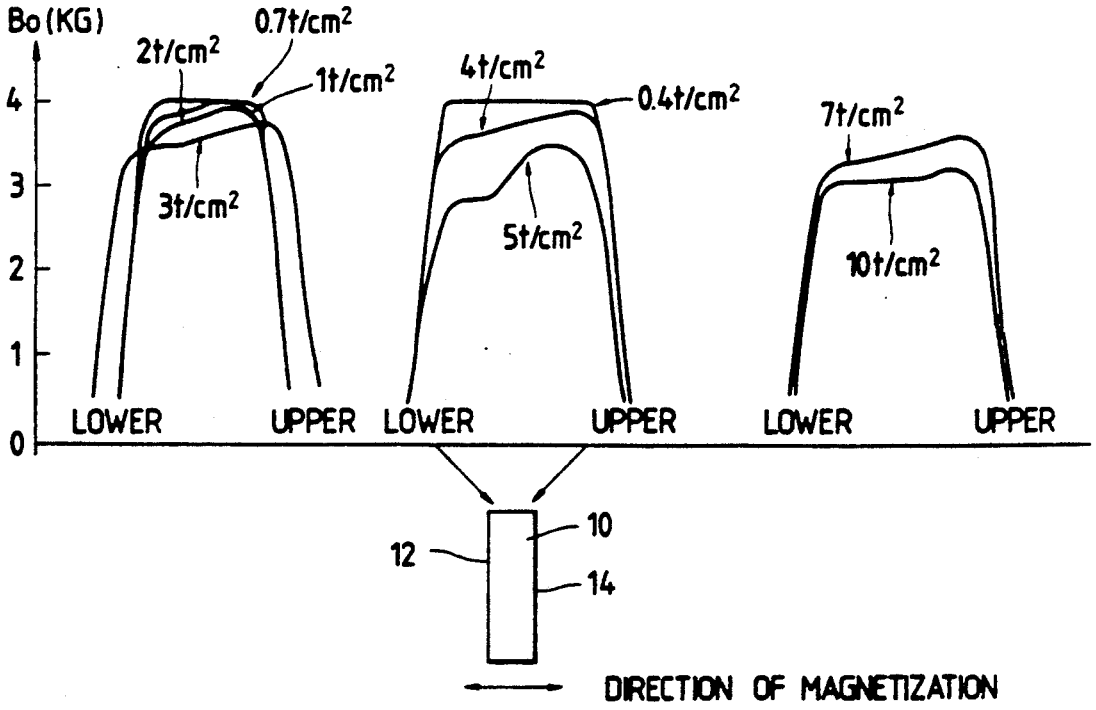
FIG. 4 is a diagram showing the distribution of surface magnetic fluxes in the permanent magnet according to an embodiment of the present invention.
Figure 5:
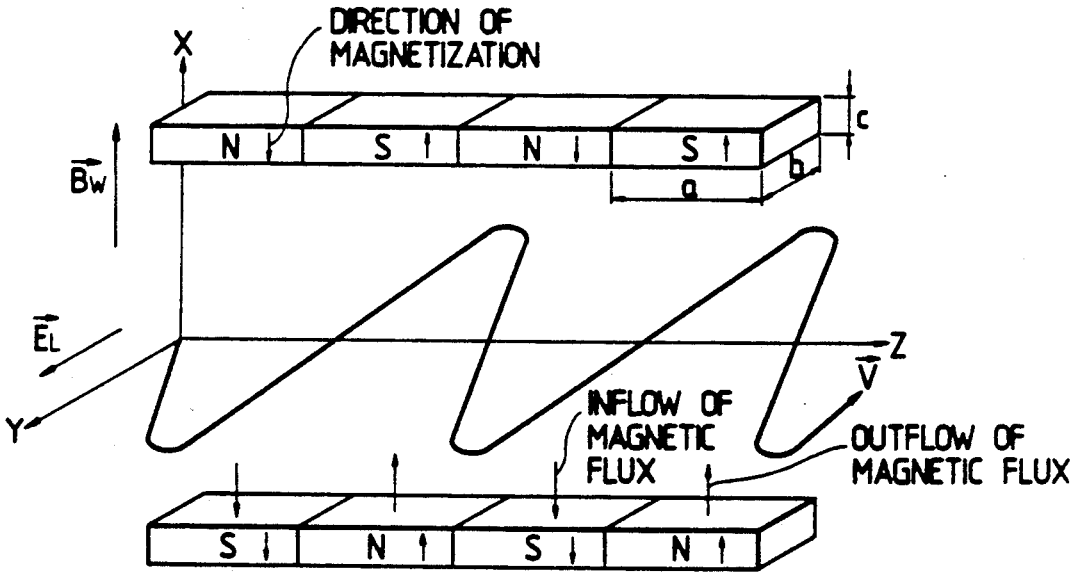
FIG. 5 is a diagram showing an example of a "wiggler" using a plurality of permanent magnets produced by the present invention.

A test piece was prepared as in Example 1 except that the pressure employed in the preliminary forming step was continually varied from 0.4 to 10 tons/cm$^2$. In order to examine the uniformity of orientation, the oxide film was removed from the surface of the test piece which was then magnetized at 25 kOe with pulses, followed by measurements of surface flux density Bo on the surface of the sintered piece with a probe model FA-22E of Siemens Aktien-gesellschaft. The results are shown in FIG. 4. The Bo measurements were conducted at the central portion of a surface of the magnet 10 which measured 45 cm×14 cm as shown under the bottom of the graph of FIG. 4. The term "lower" in FIG. 4 means the side 12 of the magnet which faced the lower punch, and "upper" means the side 14 facing the upper punch.

As one can see from FIG. 4, the surface flux density became lower than 3.5 kG when the preforming pressure exceeded 4 tons/cm$^2$. It is therefore clear that the pressure for preforming preferably is not higher than 4 tons/cm$^2$. FIG. 4 also shows that a high degree of uniformity in magnetic flux density could be attained in the direction of magnetization when the preforming pressure was no more than 4 tons/cm$^2$. In Example 2, no experiment was conducted at preforming pressures below 0.4 tons/cm$^2$ since the resulting preform was difficult to handle. However, if great care was exercised in handling, it would be possible to produce the intended rare earth based magnet of the present invention even if the preforming pressure is less than 0.4 tons/cm$^2$.

EXAMPLE 3

A permanent magnet alloy of a Nd-Fe-B system that consisted of 31.7 wt% Nd, 4.0 wt% Dy, 1.1 wt% B, 1 wt% Co, 0.8 wt% Ga and the balance Fe was reduced to fine particles as in Example 1. The resulting powder was loaded into a mold having a cavity with a cross-sectional size of 24.5 mm×120 mm and preliminary shaping was effected to form a block having a height of 95 mm. As in Example 1, a hydraulic press having a lifting capability was used to effect the preliminary forming step.

The preformed block was then subjected to CIP as in Example 1. The CIP shaped part was placed on a plurality of $Nd_2O_3$ balls (10 mmϕ) on a support table and sintered in Ar atmosphere at 1090° C for 1 h. The $Nd_2O_3$ balls were used to prevent deformation that would otherwise occur in the molding on account of thermal shrinkage during sintering. After the sintering, the sample was furnace-cooled to room temperature, re-heated at 900° C. for 2 h and continually cooled to room temperature at a rate of 1.5° C./min.

After being cooled to room temperature, the sample was subjected to an aging treatment at 580° C. No single crack developed in the sample as a result of this heat treatment. A test piece was cut from the sample as in Example 1 and subjected to measurements of its magnetic characteristics and the results were: Br=10900 g, $_BH_C$=23800 Oe; and $(BH)_{max}$=28.7 MGOe. The angle at which the direction of magnetization was inclined did not exceed 0.9 degrees in any part of the plane ab, reflecting the excellent uniformity in orientation of the sample.

The present invention successfully provides a large permanent magnet that satisfies the requirement for high orientation (i.e., the direction of magnetization shall not exceed an angle of 3 degrees with respect to the line normal to a reference plane) and which hence is suitable for use as "wigglers" in a particle accelerator or a nuclear magnetic resonance tomographic imaging device (MRI).

What is claimed is:

1. A process for producing a highly oriented rare earth base permanent magnet which satisfies a dimensional relationship a≧b>c, where a is the longer side or major axis of the magnet, b is the shorter side or minor axis of the magnet, and c is the thickness of the magnet, and which has a direction of magnetization inclined at an angle not exceeding 3 degrees with respect to the line normal to the plane defined by a and b, said process comprising the steps of:

providing a mold comprising magnetic material mold members and nonmagnetic material mold members, said magnetic material mold members and said nonmagnetic material mold members being arranged to form a cavity in said mold, said nonmagnetic material mold members projecting inwardly;

loading an alloy powder as the starting material into said mold having said cavity that satisfies a relationship A ≧B>C, where A is the longer side or major axis of the cavity, B is the shorter side or minor axis of the cavity, and C is the depth of the cavity, and said cavity being formed in a substantially uniform parallel magnetic field;

exerting a compressive force of at least 0.4 tons/cm$^2$ in a direction substantially perpendicular to the plane defined by A and C while applying a magnetic field in a direction substantially perpendicular to the plane defined by A and B, thereby effecting in-field molding so as to obtain a preform having the direction of magnetization inclined at an angle, said angle being no more than 3 degrees with respect to the line normal to the plane defined by A and B; and performing cold isostatic pressing at a pressure higher than that employed in the preforming step.

2. A process according to claim 1, wherein said compressive force is in the range of 0.4–4 tons/cm$^2$.

* * * * *